United States Patent [19]

Kleber

[11] 4,014,800

[45] Mar. 29, 1977

[54] FIBER-LUBRICATING COMPOSITIONS

[75] Inventor: Rolf Kleber, Neu-Isenburg, Germany

[73] Assignee: Hoechst Aktiengesellschaft, Frankfurt am Main, Germany

[22] Filed: May 22, 1974

[21] Appl. No.: 472,224

[30] Foreign Application Priority Data

May 26, 1973 Germany ..... 2326966

[52] U.S. Cl. ..... 252/8.8; 8/181; 8/188; 252/547

[51] Int. Cl.[2] ..... D06M 13/36

[58] Field of Search ..... 252/8.8, 547; 8/181, 8/188

[56] References Cited

UNITED STATES PATENTS

| | | | |
|---|---|---|---|
| 2,695,270 | 11/1954 | Jefferson et al. | 252/8.8 |
| 2,727,860 | 12/1955 | Duke et al. | 252/8.8 |
| 2,853,453 | 9/1958 | Elton et al. | 252/8.8 |
| 3,125,487 | 3/1964 | Hutchinson | 252/8.8 |
| 3,296,145 | 1/1967 | Findlan | 252/8.8 X |
| 3,356,727 | 12/1967 | Koebner et al. | 252/8.8 |
| 3,505,221 | 4/1970 | Waldman et al. | 252/8.8 |
| 3,623,980 | 11/1971 | Lanner et al. | 252/8.75 |
| 3,654,261 | 4/1972 | Johnson | 252/8.8 X |

*Primary Examiner*—Edward M. Woodberry
*Attorney, Agent, or Firm*—Connolly and Hutz

[57] ABSTRACT

Amine oxides of the formula $R^1R^2R^3N \rightarrow O$, in which $R^1$ is medium- to long-chain alkyl, $R^2$ is short- to long-chain alkyl or polyethyleneglycol, $R^3$ is short chain alkyl or polyethyleneglycol, with the provisos that the polyethylene glycol groups together have not more than 10 glycol units, and that $R^3$ is polyglycol if $R^2$ is medium- to long-chain alkyl, are useful as antistatic agents in lubricating agents for synthetic fibers. The amine oxides are distinguished by a good thermal stability, are low-volatile, non-corrosive, compatible with usual lubricating agents and soluble in aqueous and oily lubricating compositions.

1 Claim, No Drawings

FIBER-LUBRICATING COMPOSITIONS

It is understood that the terms "brightening, preparing or lubricating" signify the application of gliding and adhesive agents, such as oils or surface-active substances, onto the surface of fibrous materials by means of godets, by spraying, immersion or absorption from a long bath. Therein the preparation has in the first instance the task to minimise the friction between the threads or fibers and the metal parts of the transporting and processing aggregates in manufacturing and processing of the synthetic fibers (knitting, weaving and hosiery making machines). At the same time, the preparation should grant a proper performance of the bobbins and eliminate static charges often occurring in the running of the fibers. The preparation should confer to the synthetic fiber the following processing properties (H. Ludewig: PES-Fasern, Akademic-Verlag Berlin 1956, p. 271):

1. Gliding property and suppleness
2. Antistatic property
3. Good cohesion of the fibrills without smearing effect
4. No corrosion
5. No yellowing
6. Durability in stocking and fixing
7. Complete removability by washing For the preparation, mostly oily preparations from an aqueous solution have been used containing the following components:

a. oil insoluble in water (mineral or vegetable)
b. emulsifier
c. antistatic agent.

In U.S. Pat. No. 3,563,892 a fiber preparation is described which contains about 70 parts of coconut oil, about 20 parts of sulfated glycerol trioleate as emulsifier and a nonylphenol oxethylate as antistatic agent.

Due to modern production processes such as fast spinning processes or stretch texturation, the requirements of the fiber preparations in respect of thermic stability and gliding attitude become more and more important, so that the known fiber preparations do no longer reach the required demands. In order to obtain suitable gliding components stable at high temperatures for the manufacture of synthetic fibers, the oil component has been replaced by ester oils or silicone-containing preparations. The antistatic component in such preparing agents which are stable at high temperatures presents a special problem. Antistatics that are stable to a certain extent at high temperatures are recommended such as phosphoric acid mono- and diesters (Soap and Chemical Specialities, April 1962, p. 55 and following). Other products such as oxethylation products and sarcosides are either not enough soluble in the gliding components and do not provide enough antistatic or they decompose at elevated temperatures (starting at 180°–200° C).

It now was found that it is possible to obtain antistatic effects in preparations which are stable at high temperature if amine oxides of the following formula are added to the known gliding components and emulsifiers

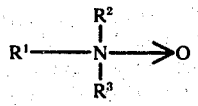

in which $R^1$ stands for an alkyl radical of 5 – 22 carbon atoms, $R^2$ for an alkyl radical of 1 to 22 carbon atoms or a polyglycol group of the formula $$-(CH_2-CH_2-O)_n-H$$

in which $n$ stands for an integer from about 1 to about 5 and $R^3$ for an alkyl radical of 1 to 5 carbon atoms or a polyglycol group of the formula $$-(CH_2-CH_2-O)_m-H$$

in which $m$ stands for an integer from about 1 to about 10, the sum of $m$ and $n$ not exceeding 10, with the proviso that $R^3$ represents the afore-mentioned polyglycol group in the case where $R^2$ stands for an alkyl group of more than 5 carbon atoms.

The choice of the radicals $R^1$, $R^2$ and $R^3$ is made in such a way that the amine oxide is soluble or dispersible in water and in water-insoluble oils. Preference is given, for example, to amine oxides of the formula

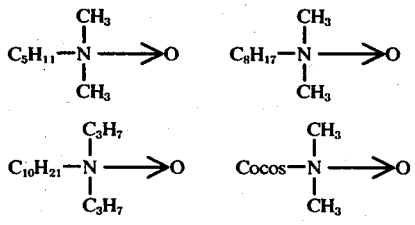

(coco = alkyl group derived from coconut fatty acid having 8 to 18 carbon atoms, the major part thereof having 12 carbon atoms).

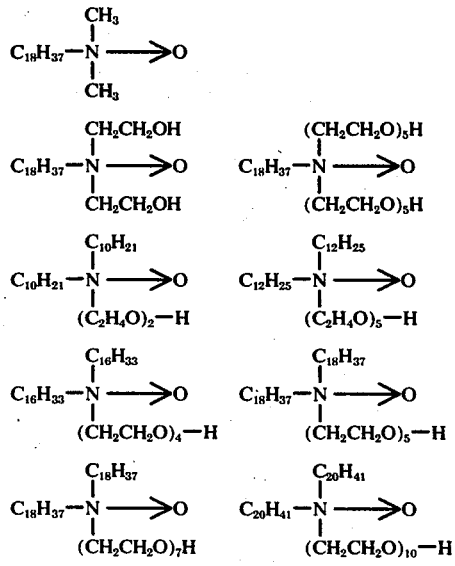

It goes without saying that instead of alkyl groups having uniform chains, compounds can in any case be used, the alkyl group of which represents technical-grade fractions, their average number of carbon atoms equalling or approximating that of the aforementioned alkyl radicals. Preference is especially given to alkyl groups derived from natural long-chained fatty acids as the corresponding tertiary amines with one or two long-chained alkyl groups which are commercially available and the amine oxides are therefore also easily obtainable or commercialized.

Generally, the integers *n* and *m* represent average values, as the technical oxalkylation results always in mixtures of products. This is also true for the instant oxethylation, products which here are formulated uniformly for reasons of simplicity.

The amino oxides present already in a relatively low dosage a high antistatic effect. The necessary quantities used are a function to type and amount of the other components (oil, emulsifier) and can easily be determined by simple preliminary tests. Generally, about 0.05 to about 3%, preferably about 0.2 to 1.2%, calculated on the weight of the substrate, are applied.

The low volatility of these compounds has to be emphasized; they can be used at high temperatures and in very fast running aggregates. These amine oxides are well soluble in paraffin oils and bring about by their simultaneous good solubility in water — a further emulsifying effect for the oil and so permit to reduce the additional necessary quality of an emulsifying component.

It goes without saying that the good effects of the amine oxides may be utilized as an additive to other water-soluble gliding agents such as oxethylated silicone derivatives.

Contrary to the before-mentioned phosphoric acid derivatives, amine oxides present a good stability at high temperatures as well as good antistatic effects. Furthermore, amine oxides present no corroding problems whilst phosphoric acid esters tend to hydrolyze in an aqueous solution liberating the acid and causing thereby corrosion. The favorable properties of the amine oxides as lubricating agents become important especially on synthetic fibers, such as polyester, polyamide-6 and polyamide-6,6, polyacrylonitrile, polyolefins and others.

The products can be used alone or combined with other known lubricants. In the following examples, parts (abbr. P) and percentages signify parts and percentage by weight.

EXAMPLE 1

Preparation for stretching while spinnning of polyethylene glycol terephthalate filaments for technical purpose.

a. According to the invention
60 P paraffin oil (density 0.88; paraffins: 64%; aromates: 1.5%; naphthenes: 34% viscosity at 20° C: 295 cP)
30 P oleyl alcohol - polyclyol ether with 7 ethyl-eneglycol units on an average (emulsifier)
10 P coconut dimethyl amine oxide b. Comparison
60 P paraffin oil as under (a)
30 P emulsifier as under (a)
10 P lauryl alcohol triphosphate c. Comparison
40 P paraffin oil DAB (=Deutsches Arzneibuch) 6 (20° C/200 cP)
25 P stearyl alcohol - polyglycol ether with 8 ethylene glycol units on an average
15 P addition product of 13 mols of ethylene oxide on technical isotridecanol (from the oxo synthesis)
20 P tri-phosphate (esterified with an equivalent of polyethylene glycol of an average molecular weight of 300 and 2 equivalents of an addition product of a technical wax alcohol and 2 mols of ethylene oxide).

The preparations (a) and (b) could be emulsified with water to give an opaque emulsion, (c) produced a milky emulsion. Volatility at 250° C/1 hour preparation a : 10%
b : 40%
c : 70%

Antistatic values in meg-Ohm when applying 0.5% of amine oxide on a polyethylene glycol terephthalate flock:

| | without heating | Heated for 1 hr. to 250° C: |
|---|---|---|
| a | 10 | 115 |
| b | 116 | ∞ |
| c | 1122 | ∞ |

(∞≙greater than $10^6$)

Similar good effects were obtained when using the compounds

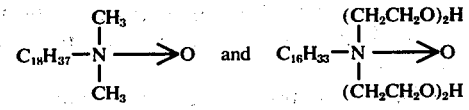

EXAMPLE 2

Texturizing preparations for polyamide-6 filaments a. According to the invention
70 P paraffin oil (as in example 1)
20 P addition product of 6 mols of ethylene oxide on 1 mole of unsaturated technical-grade alcohol of 18 carbon atoms
10 P of stearyl-bis-(pentaglycol)-amine oxide b. Comparison
90 P of commercial oxethylated non-ionic siloxan derivative (0.3% $SiO_2$-content)
7 P of addition product of 7 mols of ethylene oxide on 1 mole of castor oil
99 P of N-stearylsarcoside, sodium salt Volatility at 250° C/1 hr.

Performance of the bobbins after application of 0.3% of amine oxide on polyamide 6:

a : excellent
b : satisfactory

Similar effects were obtained when using the following compounds

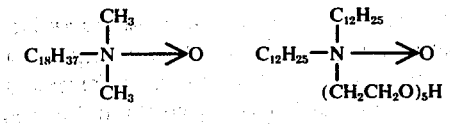

and

-continued

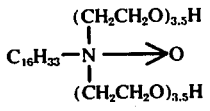

What is claimed is:

1. A fiber-lubricating composition consisting essentially of a paraffin oil or silicone oil, an emulsifier and an amine oxide of the formula

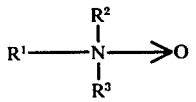

in which $R^1$ is alkyl of 5 to 22 carbon atoms, $R^2$ is alkyl of 1 to 22 carbon atoms or a polyglycol group of the formula $$-(CH_2CH_2O)_n-H$$

in which $n$ is a number of 1 to 5, and $R^3$ is alkyl of 1 to 5 carbon atoms, or a polyglycol group of the formula $$-(CH_2CH_2O)_m-H$$

in which $m$ is a number of 1 to 10, the sum of $n$ and $m$ being not more than 10, with the proviso that $R^3$ is said polyglycol group if $R^2$ is alkyl of more than 5 carbon atoms.

* * * * *